United States Patent [19]

Van Donk et al.

[11] Patent Number: 4,781,225

[45] Date of Patent: Nov. 1, 1988

[54] WEFT YARN STORE FOR A LOOM

[75] Inventors: Cornelis Van Donk, Mortel; Gerardus Cox, Geldrop, both of Netherlands

[73] Assignee: Sulzer Brothers Limited, Winterthur, Switzerland

[21] Appl. No.: 62,591

[22] Filed: Jun. 16, 1987

[30] Foreign Application Priority Data

Jun. 16, 1986 [CH] Switzerland ..... 02428/86

[51] Int. Cl.[4] ..... D03D 47/36

[52] U.S. Cl. ..... 139/452

[58] Field of Search ..... 139/435, 452; 242/47.01, 47.12, 47.13

[56] References Cited

U.S. PATENT DOCUMENTS 4,079,759 3/1978 Riha et al. ..... 139/452

FOREIGN PATENT DOCUMENTS

0080692A1 6/1983 European Pat. Off. .
0179178A1 4/1986 European Pat. Off. .
2222475A 3/1973 Fed. Rep. of Germany .
2515818A1 10/1975 Fed. Rep. of Germany .
163446 9/1984 Japan ..... 139/452
WO84/013-94A 4/1984 PCT Int'l Appl. .

*Primary Examiner*—Henry S. Jaudon
*Attorney, Agent, or Firm*—Burns, Doane, Swecker & Mathis

[57] ABSTRACT

A weft yarn store for a loom includes a stationary drum (24), a winding arm (3) for winding weft yarn (20) on to the periphery of the drum, and a separating device (11) which separates groups of yarn turns (21, 22) from one another. A clamping facility at the weft yarn departure end of the drum (24) determines the release of a length of yarn for picking into the loom. The clamping action is accomplished by such a lever (14) mounted within the drum and working against an element (15*a*) mounted outside the drum (24). The outer clamping element is resiliently mounted in a retaining element (16) which secures the drum (24) against rotation. The clamping facility (14, 15*a*) enables the weft yarn to be retained gently in a reduced space.

9 Claims, 2 Drawing Sheets

Fig. 1
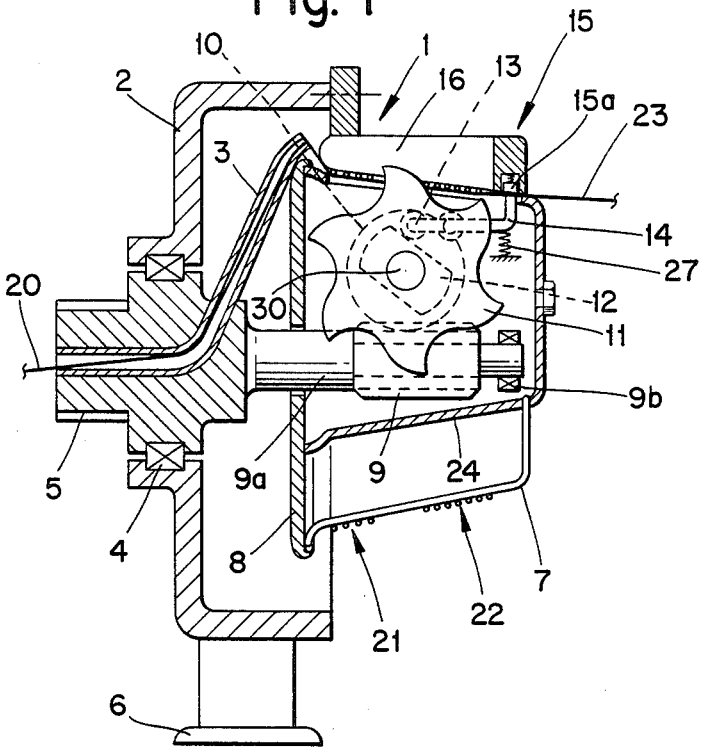
Fig. 2a
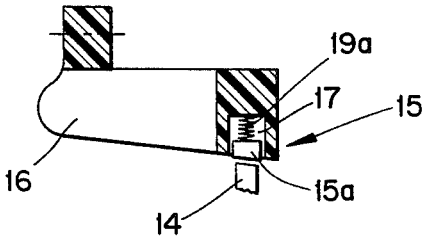
Fig. 2b
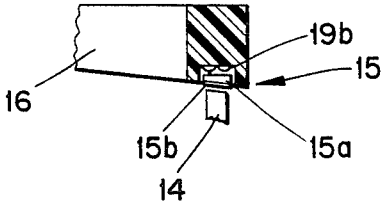
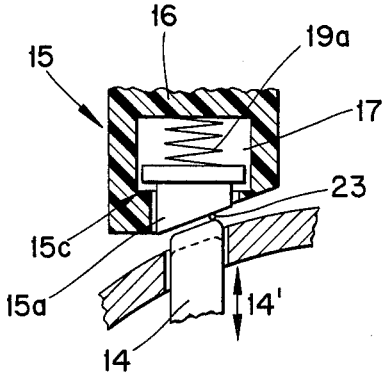
Fig. 3

WEFT YARN STORE FOR A LOOM

FIELD OF THE INVENTION

The invention relates to a loom weft yarn store for receiving yarn from a yarn package and making lengths of such yarn available at intervals to the picking instrumentalities of the loom. The invention is concerned particularly with a yarn clamping arrangement for gently clamping the yarn adjacent the discharge end of a yarn storage drum at times between loom picking operations.

BACKGROUND OF THE INVENTION

In a known type of yarn store, a winding arm serves to wind weft yarn onto the periphery of a stationary drum. During intervals between picks, a portion of the yarn leading from the periphery of the drum to an air jet or other loom picking instrumentality is held or clamped adjacent the drum and turns of yarn are accumulated on the drum. At the time of a pick, the clamp is released and there is made available to the picking jet a total length equal to the length of weft yarn to be picked into the shed of the loom.

Japanese utility model publication No. 7265/86 discloses a store in which a lever disposed outside the drum presses the weft yarn on to the drum periphery during the times when yarn is not required to be drawn off the drum. The mechanical drive of the lever makes it necessary to have a separate mounting of the drive shaft, so that additional space is required in the vicinity of the periphery of the drum. The end of the lever strikes the drum directly, and so delicate weft yarn may be damaged when it is clamped

SUMMARY OF THE INVENTION

It is an object of this invention to provide a weft yarn store whose yarn clamping means are incorporated in the store and retain the weft yarn gently.

According to the invention, a clamping member is so disposed in the drum interior as to be movable outwardly towards the weft yarn on the drum periphery, and a cooperating clamping element is mounted outside the drum to provide a yielding surface against which the weft yarn may be held by the clamping member. The clamping element may be formed from elastomeric material and/or it may be resiliently supported in a retaining element which secures the drum against rotation.

The clamping member can be driven by a pivotally mounted lever having a roller running on a cam disposed on the drive shaft of an existing device which operates to separate from one another groups of yarn turns on the drum periphery. Alternatively, an electromagnet can pull the lever outwardly towards the clamping element and when in its outer position the lever presses both against a rigid abutment and against the backing element.

The weft yarn store together with the clamping means according to the invention takes up substantially the same space as taken up by a weft yarn store without such means. Delicate weft yarns can therefore be processed without the yarn being damaged during clamping.

BRIEF DESCRIPTION OF THE DRAWINGS

The invention will be described in greater detail hereinafter with reference to the drawings wherein:

FIG. 1 is a meridian section through a weft yarn store in accordance with the present invention;

FIGS. 2*a* and 2*b* show two embodiments of the clamping element incorporated in the store shown in FIG. 1;

FIG. 3 shows the clamping element and a part of the clamping member in the operative positions thereof;

DETAILED DESCRIPTION OF PREFERRED EMBODIMENTS

Figure 6:
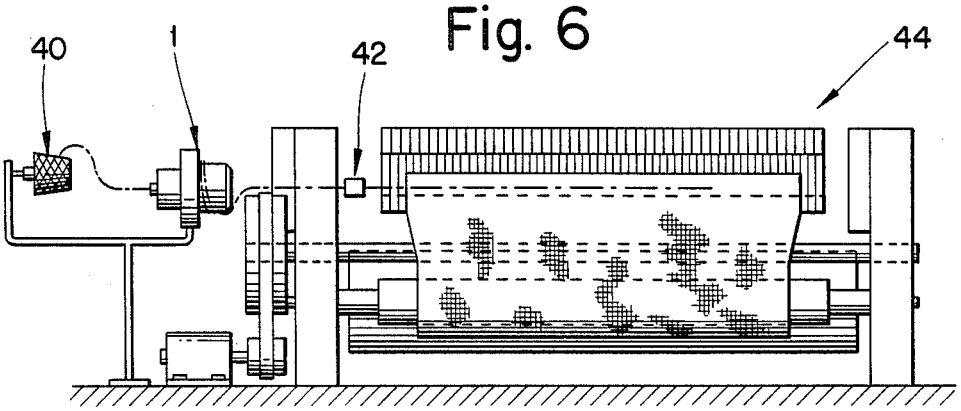
FIG. 6 is a schematic illustration of the overall arrangement in a loom provided with a yarn store.

Referring first to FIG. 6 or orientation, it will be seen that the yarn store 1 is located between a yarn package 40 and the main picking jet 42 of an air jet loom 44 which may be of known construction. Yarn may be drawn off the package 40 more or less continuously and stored temporarily as windings or turns on the surface of a drum in the store 1, to be drawn therefrom as needed by the picking jet 42.

The weft yarn store 1 includes a casing 2 attached to stationary frame means 6. Within the casing 2, a bearing 4 rotatably supports a winding arm 3 which may be driven by a conventional drive belt passing over a pulley surface 5. Weft yarn 20 is supplied along the axis of rotation of the arm 3 and is deposited in a first coil 21 and in a second coil 22 on a stationary drum 24 widened by stirrups 7 carried by a disc 8. A store of this kind having a drum 24 and additional stirrups 7 has been described, for example, in Swiss patent specification No. 639 711.

The drum 24 is mounted, with the interposition of conventional bearing means indicated diagrammatically at 9*b*, on a shaft 9*a* which co-rotates with the arm 3. A worm gear 9 drives a worm wheel 10 and, connected thereto, a wheel 11 of a dog clutch type of separating means for the coils 21, 22. A cam 12 also is driven in this way. The wheel 11 is mounted on a shaft 30 in the drum 24 and secures the drum 24 against rotation by running in a slot 18 in a retaining member 16 (FIG. 4) secured to the casing 2.

A clamping member 14 mounted inside the drum 24 cooperates with a clamping element 15 mounted outside the drum 24. The clamping member 14 is on, or forms part of, a cam follower lever provided at its opposite end with a roller 13 which runs on the rotating cam 12 and thus pivots the lever 14 against the force of a spring 27.

Figure 4:
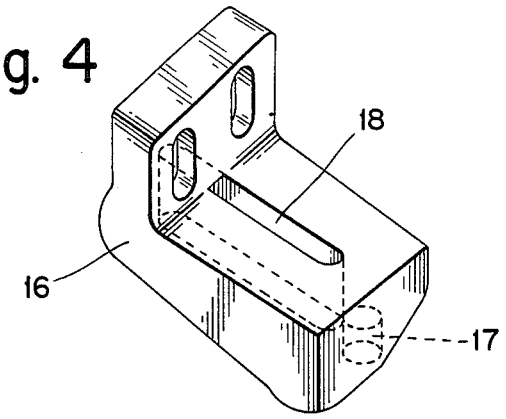
FIG. 4 shows the component of the FIG. 1 yarn store which serves both as a retaining element for the clamping element and as a means for holding the yarn drum stationary.

The clamping element 15 is received in a retaining element 16 shown on an enlarged scale in FIG. 4. The part 15*a* of the clamping element 15 serves as a backing against which the clamping member 14 presses the weft yarn to be clamped and held adjacent the periphery of the drum 24. This part 15*a* can be pressed by means of a torsion spring 19*a* or an ordinary spring 19*b*, as shown in FIGS. 2*a* and 2*b* respectively, against an abutment surface 15*c* in FIG. 3.

Also, the element 15*a* can be made of an elastomeric substance. If it fills up the space for the element 15, the backing element 15*a* can be used without any spring 19*a* or 19*b*.

For some yarns it may be convenient if the element 15*a* is replaced by a backing plate 15*b* made, for example, of ceramic.

When the yarn 23 leaving the drum is clamped fast, the engagement of the member 14 with the element 15*a* moves the latter in the bore 17. The clamping force acting on the yarn 23 can be accurately determined by choice of the spring rate of the springs 19*a*, 19*b*. Since the element 15*a* is relatively small and of low mass, the yarn 23 is clamped gently when the member 14 engages the element 15*a*.

Figure 5:
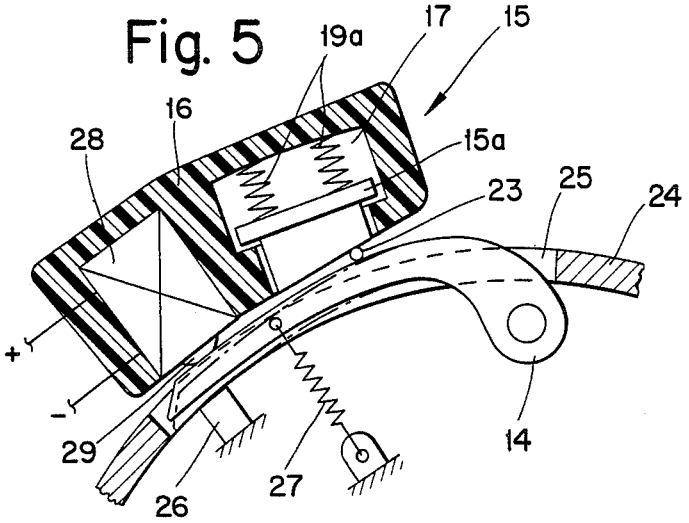
FIG. 5 shows an alternative electromagnetic drive for the clamping member.

FIG. 5 shows a magnetic actuation of the member 14. An electromagnet 28 can pull the lever 14 from an inner (withdrawn) position into its solid-line clamping position on the abutment 29. When the magnet 28 is in the deenergized state, the spring 27 pulls the member 14 back towards the abutment 26 inside the drum. Here the member 14 is disposed substantially in a slot 25 in the drum 24.

The operation of the store has been described, for example, in Swiss patent specification 639 711, the disclosure of which is incoporated herein by reference. The clamping means embodied by the components 14 and 15 determines the release of yarn 23 or of the second yarn coil 22 for departure from the drum when the separating means 11 has moved this yarn coil towards the departure end of the drum 24. The draw-off of weft yarn 22 terminates when all the turns of yarn in this part of the drum have been drawn off. Thereafter, the member 14 moves back towards the clamping element 15 to retain the yarn 23 again.

What is claimed is:

1. A loom weft yarn store for receiving yarn from a weft yarn package and making lengths of such yarn available at intervals to the weft picking instrumentalities of the loom, said store comprising a stationary drum; a winding arm for winding weft yarn on to the periphery of the drum; separating means for separating a number of yarn turns of a total length equal to the length of weft yarn to be picked into the shed of the loom from other yarn turns on said periphery; and means operable in timed relation to the picking operations for clamping during intervals between picks the weft yarn at the drum end where it runs off the drum, the weft yarn being clamped adjacent the drum periphery said means for clamping the weft yarn including a clamping member disposed in the drum interior and movable outwardly towards the weft yarn at the drum periphery, a clamping element outside the drum in the path of said clamping member, and a resilient backing for said clamping element, whereby the weft yarn may be clamped between said clamping element and said clamping member.

2. A store according to claim 1, including a retaining element for receiving said clamping element and for securing said drum against rotation.

3. A store according to claim 2, wherein said clamping element is so mounted in said retaining element as to be movable.

4. A store according to claim 2, wherein said clamping element is borne in said retaining element by way of spring means.

5. A store according to claim 1, wherein said clamping member is a lever which is pivotally mounted within the drum and which runs with the interposition of a roller on a cam driven together with said separating means.

6. A store according to claim 1, including an electromagnet for driving said clamping member and a rigid abutment against which said clamping member may be drawn as it moves into claimping relation to said clamping element.

7. A loom weft yarn store for receiving yarn from a weft yarn package and making lengths of such yarn available at intervals to the weft picking instrumentalities of the loom, said store comprising drum means for receiving windings of yarn on its periphery and means for periodically clamping the weft yarn adjacent the discharge end of the drum, said clamping means including a clamping element outside the drum means, a clamping member mounted inside the drum means for movement into and out of contact with said clamping element, and means inside said drum means connected to said clamping member for moving said clamping member in and out with respect to said drum means to clamp the yarn between said clamping element and said clamping member, said clamping element bearing yieldingly against said clamping member when said clamping member and said clamping element clamp the weft yarn therebetween.

8. A store according to claim 7, wherein said clamping element is made of an elastomeric substance.

9. A loom weft yarn store for receiving yarn from a weft yarn package and making lengths of such a yarn available at intervals to the weft picking instrumentalities of the loom; said store comprising drum means for receiving windings of yarn on its periphery and having a slot in its periphery near its discharge end, and means for periodically clamping the weft yarn adjacent said discharge end of the drum; said clamping means including a clamping element outside the drum means and facing said slot, a clamping lever pivotally mounted inside the drum means for pivoting movement outwardly through said slot to bring a surface portion thereof toward said clamping element, a fixed abutment for limiting movement of said lever in the direction of said clamping element, means for yieldingly urging said lever inwardly of said slot to position said lever within said drum means, and means for moving said lever outwardly into contact with said abutment to clamp the yarn between said clamping element and said surface portion of said clamping lever, said clamping element bearing yieldingly against said clamping lever when said claimping lever and said clamping element clamp the weft yarn therebetween.

* * * * *